US005630279A

United States Patent [19]

Slates

[11] Patent Number: 5,630,279

[45] Date of Patent: May 20, 1997

[54] BOW SIGHT HAVING AN ADJUSTABLE LEVEL

[75] Inventor: Scott O. Slates, St. Charles, Mo.

[73] Assignee: Toxonics Manufacturing, Inc., Wentzville, Mo.

[21] Appl. No.: 494,945

[22] Filed: Jun. 26, 1995

[51] Int. Cl.[6] ..... F41G 1/467

[52] U.S. Cl. ..... 33/265; 33/354; 124/87

[58] Field of Search ..... 33/265, 241, 233, 33/354; 124/87; 42/100, 101

[56] References Cited

U.S. PATENT DOCUMENTS

| | | | |
|---|---|---|---|
| 1,817,671 | 8/1931 | Brunstetter et al. | 33/354 |
| 3,674,002 | 7/1972 | Diamond, Sr. | 33/265 |
| 3,854,217 | 12/1974 | Killian . | |
| 4,020,560 | 5/1977 | Heck . | |
| 4,535,747 | 8/1985 | Kudlacek . | |
| 4,567,668 | 2/1986 | King et al. | 33/265 |
| 4,757,614 | 7/1988 | Kudlacek . | |
| 4,875,290 | 10/1989 | Finch . | |
| 5,072,716 | 12/1991 | Sappington . | |
| 5,174,269 | 12/1992 | Sappington . | |
| 5,289,814 | 3/1994 | Maisano . | |
| 5,303,479 | 4/1994 | Rudovsky | 33/265 |
| 5,339,227 | 8/1994 | Jones | 33/265 |
| 5,379,746 | 1/1995 | Sappington . | |
| 5,524,351 | 6/1996 | Pinson et al. | 33/265 |

*Primary Examiner*—William A. Cuchlinski, Jr.
*Assistant Examiner*—Andrew Hirshfeld
*Attorney, Agent, or Firm*—Paul M. Denk

[57] ABSTRACT

A cross-hair sight of the present invention includes a frame, a cross-hair or horizontal sighting pin secured in the frame, and a level mounted in the frame to be generally parallel to the horizontal sighting pin. A pair of generally circular openings are formed in the radial outer surface of the frame and the level is journaled in the openings. The openings have a diameter larger than the diameter of the level, and a pair of adjusting screws are provided which secure the level in holes. The position of the level relative to the sight frame may be adjusted to square the level to the bow by adjusting the adjusting screws without the need to adjust the position of the sight relative to the bow.

3 Claims, 2 Drawing Sheets

BOW SIGHT HAVING AN ADJUSTABLE LEVEL

BACKGROUND OF THE INVENTION

This invention relates to bow sights, and in particular to a bow sight having an adjustable level.

Archers typically use cross-hair or other similar sights when they engage in target shooting, as opposed to game hunting. Many such bow sights now include levels. With such bow sights, it is important that the level be square with, or perpendicular to, the bow. However, when the sight is mounted to the bow, the level may not be squared with the bow. The sights which include levels typically fix the level to the sight, and thus, the only way to square the level with the bow is to adjust the sight. For many sights, this adjustment can be difficult, if not impossible.

SUMMARY OF THE INVENTION

One object of the present invention is to provide a bow sight which has a level.

Another object of the invention is to provide such a bow sight wherein the level may easily be squared with the bow.

Another object of the invention is to provide a bow sight wherein the level may be squared with the bow without the need to adjust the sight.

Another object is to provide such a bow sight wherein the level is movable relative to the bow sight so as to be adjustable.

These and other objects will become apparent to those skilled in the art in light of the following disclosure and accompanying drawings.

In accordance with the invention, generally stated, a cross-hair sight for a bow is provided. The sight includes a frame, a cross-hair or horizontal sighting pin secured in the frame or other sighting instrument, and a level mounted in the frame to be generally parallel to the horizontal sighting pin. The frame has a radial outer surface and a front surface. A pair of generally circular openings are formed in the radial outer surface and the level is journaled in the openings. The openings have a diameter larger than the diameter of the level, and a pair of adjusting screws are provided which secure the level in holes. The position of the level relative to the sight frame may be adjusted to square the level to the bow by adjusting the adjusting screws. A center screw extends through the outer radial surface beneath the level to further facilitate securing the level in the desired position. The level may thus be easily squared relative to the bow by turning a pair of screws and without the need to adjust the position of the sight.

DESCRIPTION OF THE PREFERRED EMBODIMENT

Figure 1:
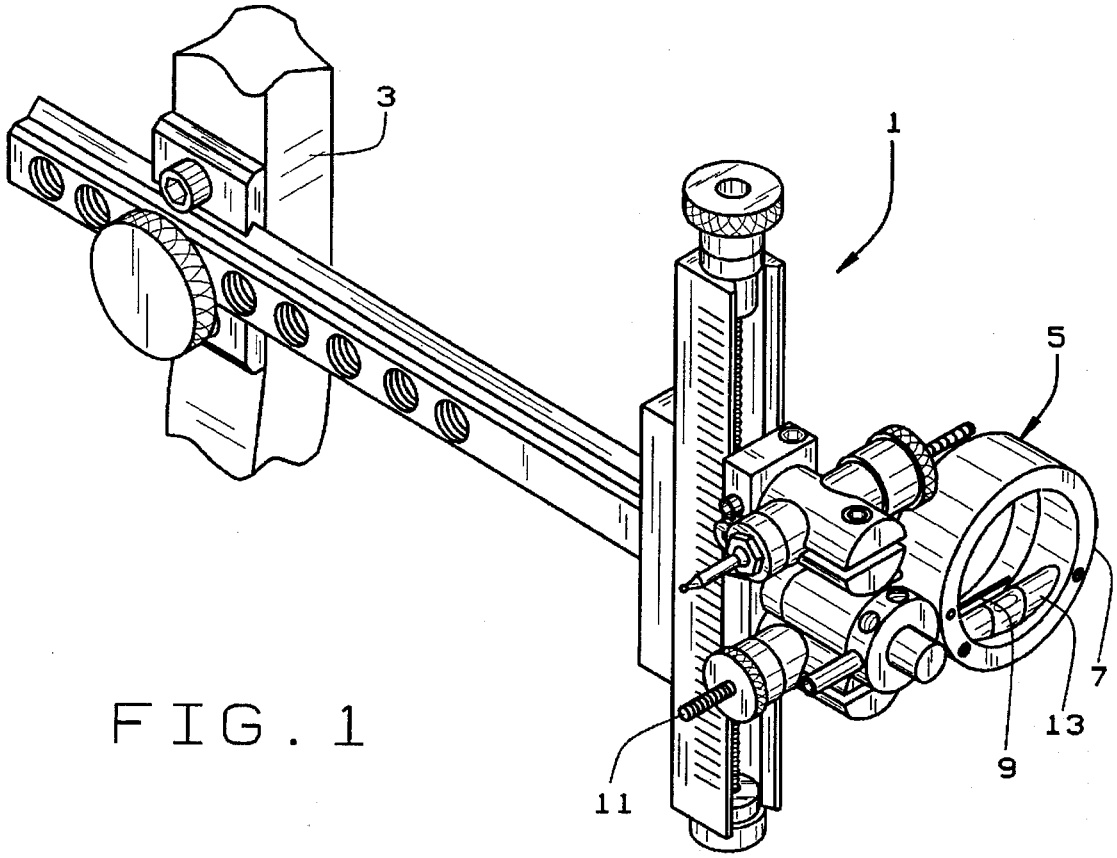
FIG. 1 is a is a perspective view of a bow sight of the present invention mounted to a bow.
Figure 2:
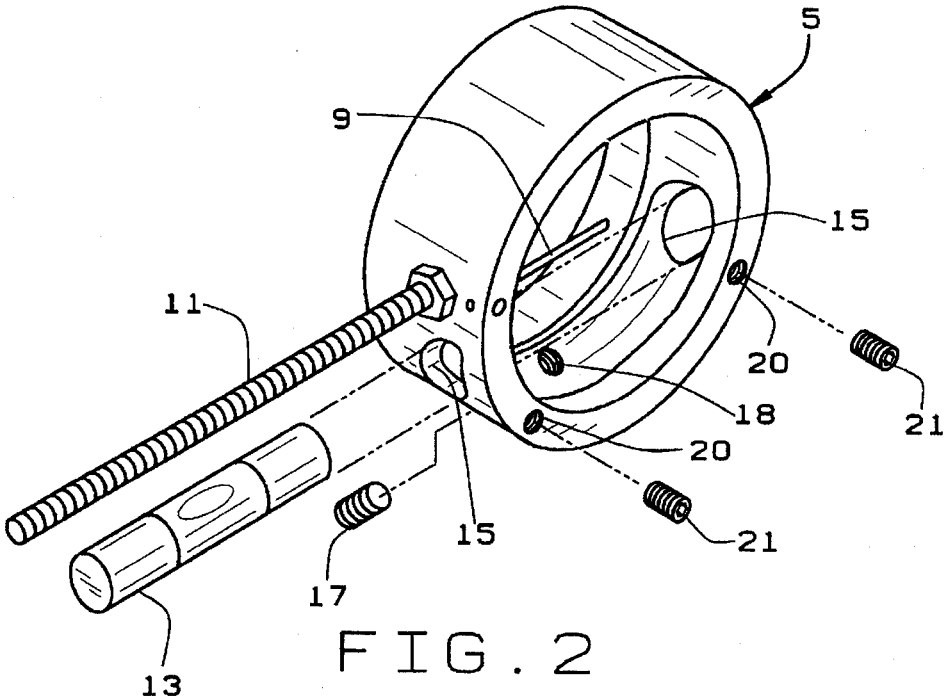
FIG. 2 is a partially exploded view of the bow sight.

In FIG. 1, a bow sight assembly 1 is shown mounted to a bow 3. The sight assembly 1 includes a cross-hair sight 5 of the present invention. Sight 5 has a generally circular frame 7 which holds the cross-hairs, or, as shown in the drawing, an aiming pin 9, and a level 13. Even fibre optic sight means could be used in the sight. The aiming pin 9 is generally horizontal and extends along the diameter of the frame 7 a distance such that the end of the pin 9 is at the approximate center of the circle defined by the frame 7. A threaded shaft 11 extends from the frame 7 to secure the sight 5 to the sight assembly 1. The level 13 has a longitudinal axis generally parallel to the shaft 11 and the pin 9, and generally perpendicular to the bow 3. The level 13 is preferably a bubble level, but any type of level may be used.

Figure 3:
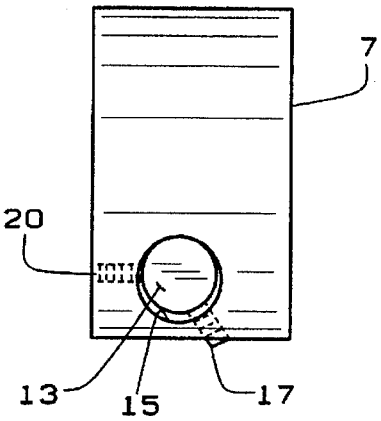
FIG. 3 is a side elevational view of the bow sight.
Figure 4:
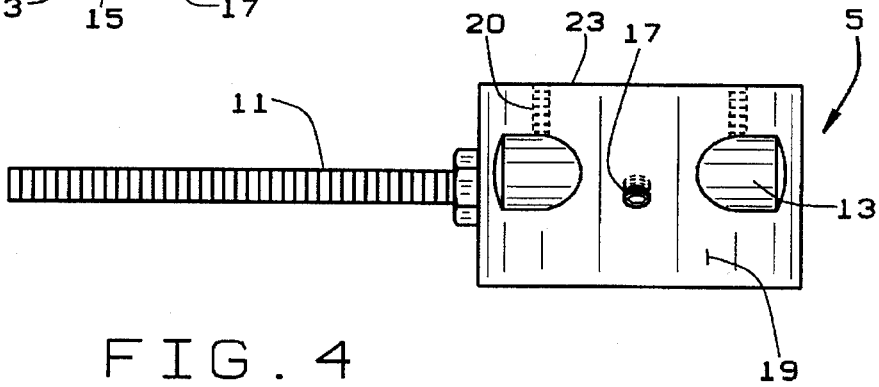
FIG. 4 is a bottom plan view of the bow sight.
Figure 5:
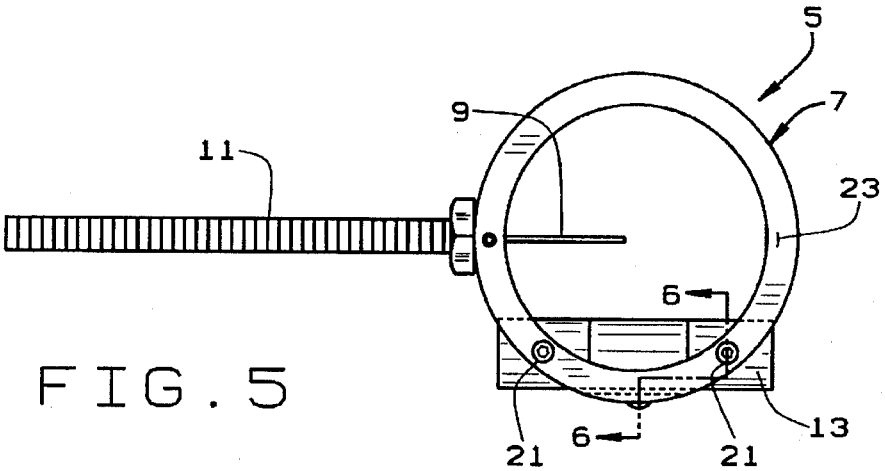
FIG. 5 is a front elevational view of the bow sight.
Figure 6:
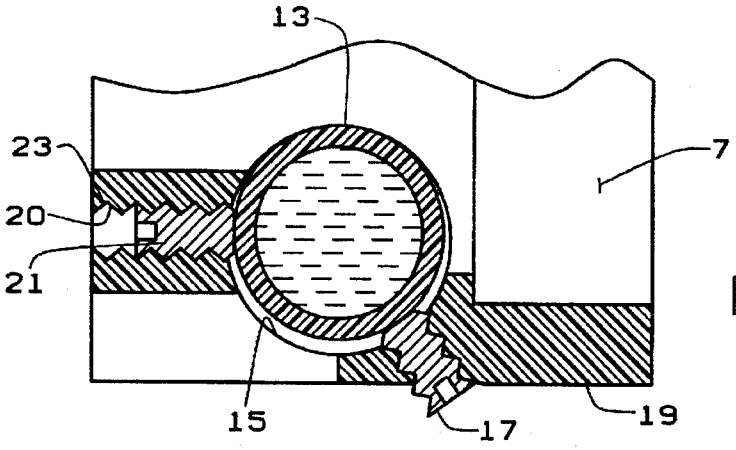
FIG. 6 is a cross-sectional view taken along line 6—6 of FIG. 5.

The frame 7 defines two coaxially aligned, generally circular openings 15 which are off-set from the diameter of the frame. The level 13 is journaled in the holes 15 to be mounted in the frame 7. It is desirable to have the level 13 be square to the bow 3 when the bow sight 5 is mounted to the bow. As best seen in FIGS. 3 and 6, the holes 15 are larger in diameter than the level 13. This allows for adjustment of the level, as will be described below, to square the level 13 to the bow 3.

The level 13 is secured in place by three screws: a center screw 17 which extends through an axial outer surface 19 of frame 7 and two side screws 21 which extend through a front surface 23 of frame 7. The frame has corresponding screw holes 18 and 20 which receive screws 17 and 21, respectively. Screw holes 20 extend through the front surface 23 and extend to holes 15. Preferably, the center screw 17 and the screw hole 18 are at a diagonal to the plane of the frame 7, to urge the level 13 upwardly and forwardly when screw 17 is tightened. Screw 17 is preferably off-set from the transverse center of the level 13 (i.e. is not directly below the center of a circle defined by the level), but is located axially at the approximate longitudinal center of the level 13. The side screws 21 are generally perpendicular to the face 23 of the frame 7.

As can be appreciated, the side screws 21 extend through screw holes 20 into holes 15 to urge the level against the surface or edge of the holes and screw 17 extends diagonally through the frame 7 into the area defined or encircled by the frame to aid in securing the level in place. When the sight assembly 1 is mounted to the bow 3, or the sight 5 is otherwise adjusted, the level 13 can be squared to the bow 3 by loosening the screw 17 so that it is out of contact with the level, and adjusting screws 21. By adjusting screws 21 so that the level will be moved relative to holes 15. The screws 21 are thus moved to properly adjust the level until the level is square. The Level is then secured in place by tightening the center screw 17. As can be appreciated, the sight of the present invention allows for squaring the level relative to the bow without the need to adjust the sight. The level is thus adjusted independently of the sight. As variations within the scope of the appended claims may be apparent to those skilled in the art, the foregoing description is set forth only for illustrative purposes and is not meant to be limiting. For example, if the two screws 21 securely hold the level 13 in the desired position, the center screw 17 can be omitted. This example is merely illustrative.

I claim:

1. A sight for a bow, the sight including a frame, sighting means, including a horizontal member, secured in the frame, and a level secured in the frame to be generally parallel to the horizontal sighting member, said level securing in the bottom portion of said frame, said frame having an axially outer surface and a front surface, said axially outer surface defining a pair of openings through which said level is journaled, said openings being co-axially aligned to be generally parallel to, and off-set from, said horizontal sighting member, said openings having a diameter larger than a diameter of said level, said level being adjustable in said openings such that said level can be squared to said bow independent of the position of the sight, said level being secured in a desired position relative to said frame by a pair of outer screws and a center screw, said frame including first screw holes which extend through said front surface to said openings, said outer screws threadedly engaging within said first screw holes and bearing against said level to secure said level in a desired adjusted position, said outer screws being independently adjustable in said first screw holes to adjust the position of said level relative to said sight frame, said center screw extending through said frame radially of its outer surface, said center screw being located in approximate the bottom portion of said frame and provided for further tightening of said level into its adjusted position after said outer screws have tightened said level into the adjusted position.

2. The sight of claim 1 wherein said center screw when tightened against said level is located at a longitudinal center of said level and is off-set from a location vertically below a transverse center of said level.

3. The sight of claim 2 wherein said center screw is diagonal relative to a vertical plane of said frame, said plane extending through said horizontal sighting member.

* * * * *